US007098729B2

(12) United States Patent
Abe

(10) Patent No.: US 7,098,729 B2
(45) Date of Patent: Aug. 29, 2006

(54) BAND GAP CIRCUIT

(75) Inventor: Osamu Abe, Kanagawa (JP)

(73) Assignee: NEC Electronicss Corporation, Kanagawa (JP)

( * ) Notice: Subject to any disclaimer, the term of this patent is extended or adjusted under 35 U.S.C. 154(b) by 0 days.

(21) Appl. No.: 10/647,468

(22) Filed: Aug. 26, 2003

(65) Prior Publication Data

US 2004/0051581 A1 Mar. 18, 2004

(30) Foreign Application Priority Data

Aug. 28, 2002 (JP) ..... 2002-249352

(51) Int. Cl.
*G05F 1/575* (2006.01)
*G05F 1/46* (2006.01)

(52) U.S. Cl. ..... 327/539; 323/313

(58) Field of Classification Search ..... 327/539; 323/313

See application file for complete search history.

(56) References Cited

U.S. PATENT DOCUMENTS

| | | | | |
|---|---|---|---|---|
| 4,943,737 | A * | 7/1990 | Guo et al. | 327/542 |
| 5,229,710 | A * | 7/1993 | Kraus et al. | 323/313 |
| 5,281,866 | A | 1/1994 | Rundel | 327/344 |
| 5,892,381 | A | 4/1999 | Koifman et al. | 327/198 |
| 5,994,887 | A * | 11/1999 | Tokuda | 323/313 |
| 6,011,429 | A * | 1/2000 | Oda | 327/546 |
| 6,031,365 | A | 2/2000 | Sharpe-Gelder | 323/313 |
| 6,150,872 | A * | 11/2000 | McNeill et al. | 327/539 |
| 6,278,320 | B1 | 8/2001 | Vu | 327/539 |
| 6,294,902 | B1 * | 9/2001 | Moreland et al. | 323/268 |
| 6,377,085 | B1 * | 4/2002 | Giuroiu | 327/66 |
| 6,501,299 | B1 * | 12/2002 | Kim et al. | 326/83 |
| 6,657,480 | B1 * | 12/2003 | Ochi | 327/539 |
| 6,737,908 | B1 * | 5/2004 | Mottola et al. | 327/539 |

FOREIGN PATENT DOCUMENTS

| | | |
|---|---|---|
| JP | 2002-123325 | 4/2002 |
| TW | 210414 | 8/1993 |

OTHER PUBLICATIONS

Hitoshi Tanaka, et al., "A Precise On-Chip Voltage Generator for a Gigascale DRAM with a Negative World-Line Scheme", *IEEE Journal of Solid-State Circuites*, vol. 34 No. 8, Aug. 1999, pp. 1084-1089.

European Search Report dated Aug. 10, 2004.

Taiwan Office Action dated Apr. 8, 2005 (with English translation).

* cited by examiner

*Primary Examiner*—Terry D. Cunningham
*Assistant Examiner*—Terry L. Englund
(74) *Attorney, Agent, or Firm*—McGinn IP Law Group, PLLC

(57) ABSTRACT

A band gap circuit, including a differential amplifier. In response to fluctuation of the voltage on the band gap circuit output terminal VOUT, a potential difference occurs at an inverting input terminal and a noninverting input terminal of the differential amplifier. A transistor, connected to the output terminal VOUT, ground, an output terminal of the differential amplifier, causes excess current from the output terminal VOUT to flow to ground in response to fluctuation of the potential at the output terminal of the differential amplifier. A transistor that has a resistive component and a resistor that has a capacitive component are connected between a power supply voltage VDD and the output terminal VOUT.

16 Claims, 8 Drawing Sheets

BAND GAP CIRCUIT

BACKGROUND OF THE INVENTION

The present invention relates to a band gap circuit in which an operation is performed in a high-frequency region by employing a low-voltage power supply.

Conventionally, a semiconductor integrated circuit is provided with a reference voltage generation circuit for stably generating a reference voltage for use in a D/A converter etc. As to the reference voltage generation circuit, there is a band gap circuit in which a difference of a threshold voltage of a transistor is utilized. The band gap circuit prevents the semiconductor integrated circuit from malfunctioning due to the rising of the voltage that occurs at the time of introducing the power supply of the semiconductor integrated circuit, and fluctuation etc. of a power supply voltage that occurs during the operation, and reduces power supply voltage dependency of the semiconductor integrated circuit. Also, this band gap circuit also generates the reference voltage stabilized against temperature to reduce temperature dependency of the reference voltage.

In recent years, high speed processing of a logic circuit employing the low-voltage power supply has been performed, and the high-speed processing has been performed in the order of GHz. Power supply noise in 5% or something like this is actualized in performing the high-speed processing of the logic circuit employing the low-voltage power in such a manner, and the band gap circuit having an excellent PSRR (Power Supply Rejection Ratio) has been required more positively than it was required so far.

As the band gap circuit that corresponds to the semiconductor integrated circuit to which the voltage is applied by the low-voltage power supply and which is driven at a high speed, are known a current-mirror band gap circuit employing a current mirror, a differential band gap circuit employing a differential amplifier, and the like, for example, as described in "A Precise On-Chip Voltage Generator for a Gigascale DRAM with a Negative Word-Line Scheme", IEEE JOURNAL OF SOLID-STATE CIRCUITS. VOL. 34. NO. 8. AUGUST 1999. The current-mirror band gap circuit and the differential band gap circuit like this will be explained by referring to the accompanied drawings.

As shown in FIG. 8, the current-mirror band gap circuit has a p-type transistor P11, a p-type transistor P12, an n-type transistor N11, and an n-type transistor N12. A p-type transistor P13 has its gate connected between the n-type transistor N12 and the p-type transistor P12 in this current-mirror band gap circuit.

Furthermore, as shown in FIG. 8, in this current-mirror band gap circuit, a resistor R11 and a diode D12 are connected between the n-type transistor N12 and a negative power supply point. And, a resistor R12 and a diode D13 are connected between an output terminal VOUT and the negative power supply. Furthermore, the diode D11 is connected between the n-type transistor N11 and the negative power supply. Also, these resistors R11 and R12, and diodes D12 and D13 have a function of discharging a current that transitionally flows into the output terminal VOUT at the time of introducing the power supply and of fluctuation thereof.

FIG. 9 is one example of a characteristic view illustrating power supply voltage dependency in the current-mirror band gap circuit. In FIG. 9, a power supply voltage VDD was set in a transverse axis, and a voltage of an output terminal VOUT in an axis of ordinates. As shown in FIG. 9, it is necessary to apply an input voltage VDD of at least approx. 1.5 V to an input terminal in operating the conventional current-mirror band gap circuit. At this time, the current-mirror band gap circuit operates with the output voltage VOUT thereof at approx. 1.25 V.

FIG. 10 illustrates the conventional differential band gap circuit. As shown in FIG. 10, the differential band gap circuit has a differential amplifier to be configured of a pair of p-type transistors P1 and P2, and a pair of n-type transistors N1 and N2. This differential amplifier has the gate of p-type transistor P3 connected between the p-type transistor P2 and the n-type transistor N2 thereof, and this p-type transistor P3 is connected to the output terminal VOUT.

The resistor R2, and the resistor R1 and the diode D1, which are connected between this resistor R2 and the ground, are connected to the output terminal VOUT in this order. Also, as shown in FIG. 10, in addition to these resistors R1 and R2 and the diode D1, the resistor R3 and the diode D2 are connected between the output terminal VOUT and the ground in this order. A noninverting terminal of the differential amplifier is connected between the resistor R1 and the resistor R2, and an inverting terminal thereof is connected between the resistor R3 and the diode D2. Also, in the differential band gap circuit, similarly to the current-mirror band gap circuit, the current, which flows into the output terminal VOUT, is discharged from the resistors R1, R2, and R3, and the diodes D1 and D2.

FIG. 11 is one example of a characteristic view illustrating power supply voltage dependency in the differential band gap circuit. In FIG. 11, the power supply voltage VDD was set in a transverse axis, and the voltage of the output terminal VOUT in an axis of ordinates. As shown in FIG. 11, it is necessary to apply an input voltage VDD of at least approx. 1.25 V to the input terminal in operating the conventional differential band gap circuit. At this time, the conventional differential band gap circuit operates with the output voltage VOUT thereof at approx. 1.25 V.

In such a manner, in the differential band gap circuit, the operation can be stably performed at a lower power supply voltage than it can be performed in the current-mirror band gap circuit. For this, in the event of operating the logic circuit at a low power supply voltage, the differential band gap circuit is utilized more frequently than the current-mirror band gap circuit. Furthermore, the differential band gap circuit, which is higher in the PSRR in a high-frequency region than the current-mirror band gap circuit because a negative feedback is applied with the differential amplifier, is employed in operating the logic circuit etc. at a high speed.

As mentioned before, in the conventional current-mirror band gap circuit and differential band gap circuit, the current that flows into the output terminal VOUT is discharged at the resistor and the diode. As it is, discharging ability of the resistor and the diode is poor in the conventional band gap circuit, whereby the current, which flows into the output terminal VOUT at the time of introducing the power supply and of fluctuation thereof, is impossible to discharge up. For this, the power supply rejection ratio (PSRR) lowers in the conventional band gap circuit.

Furthermore, in the conventional band gap circuit, being accompanied by development in low power consumption, the current that flows into the output terminal VOUT at the time of introducing the power supply and of fluctuation thereof is impossible to discharge up, whereby the problem exists that a stability time of the voltage at the output terminal VOUT at the time of starting is delayed and aggregated.

A reference voltage generator for quickly raising the reference voltage at the time of introducing the power supply voltage was disclosed in JP-P2002-123325A. However, the band gap circuit of JP-P2002-123325A, which is an electronic control device to be used for controlling an engine and an automatic transmission of an automobile etc., is a reference voltage generator for generating the reference voltage necessary for making an A/D conversion etc.

Also, there are many elements in the reference voltage generator of JP-P2002-123325A for the reason of its application, which are driven by employing a high-voltage power supply. For this, in the band gap apparatus of this reference voltage generator, in the event of driving the semiconductor integrated circuit at a high speed with the lower-voltage power supply, it becomes very difficult. For example, the voltage of 1.5 V is applied for driving in the recent year's high-speed band gap circuit employing the low-voltage power supply. To the contrary, in the reference voltage generator of JP-P2002-123325A, the voltage of 7 to 8 V or something like this is applied to the band gap circuit for driving, whereby the reference voltage generator in JP-P2002-123325A is impossible to drive by means of the low-voltage power supply.

In such a manner, in the conventional band gap circuit, the excess current that transitionally flows into the circuit output terminal is impossible to efficiently discharge in performing the operation at the low power supply voltage, whereby the problem existed that the PSRR lowered and furthermore the stability time of the voltage at the circuit output terminal was aggravated.

SUMMARY OF THE INVENTION

The present invention has been accomplished so as to solve such problems, and an objective thereof is to provide the band gap circuit in which the excess current can be efficiently removed that transitionally sneaks into the circuit output terminal, the PSRR is enhanced, and the stability time of the voltage at the circuit output terminal can be curtailed.

The band gap circuit relating to the present invention that is a band gap circuit for generating an output voltage to output it from a circuit output terminal, which is connected to a power supply voltage and a reference potential, comprises a differential amplifier (for example, a differential amplifier to be configured of n-channel transistors N4 and N5, and p-channel transistors P6 and P7 in embodiments of the present invention) having an inverting input terminal, a noninverting input terminal, and an output terminal; a first circuit (for example, a circuit to be configured of resistors R1 and R2, and diodes D1 and D2 in the embodiments of the present invention) for causing a potential difference to occur at said inverting input terminal and said noninverting input terminal responding to fluctuation of the voltage of said circuit output terminal; and a switching element (for example, an n-channel transistor N3 in the embodiments of the present invention) for causing the excess current of said circuit output terminal to flow in said reference potential responding to fluctuation of the potential at said output terminal of said differential amplifier, said switching element being connected to said circuit output terminal and said reference potential and being directly connected to said output terminal of said differential amplifier. Such a configuration allows the excess current, which transitionally sneaks into the circuit output terminal, to be efficiently removed.

Furthermore, the band gap circuit relating to the present invention has a first element (for example, a p-channel transistor P5 in the embodiments of the present invention) having a resistive component and a second element (for example, a resistor R2 in the embodiments of the present invention) having a capacitive component connected, wherein said first element and said second element remove power supply noise of said power supply voltage. This allows current noise of the power supply voltage to be removed, and the excess current, which transitionally sneaks into the circuit output terminal, to be removed surely.

The band gap circuit relating to the present invention that is a band gap circuit for generating an output voltage to output it from a circuit output terminal, which is connected to a power supply voltage and a reference potential, said band gap circuit comprises: a differential amplifier (for example, a differential amplifier to be configured of n-channel transistors N4 and N5, and p-channel transistors P6 and P7 in the embodiments of the present invention) having an inverting input terminal, a noninverting input terminal, and an output terminal; a first circuit (for example, a circuit to be configured of resistors R1, R2, and R3, and diodes D1 and D2 in the embodiments of the present invention) for causing a potential difference to occur at said inverting input terminal and said noninverting input terminal responding to fluctuation of the voltage of said circuit output terminal; a switching element (for example, an n-channel transistor N3 in the embodiments of the present invention) for causing an excess current of said circuit output terminal to flow in said reference potential responding to fluctuation of the potential at said output terminal of said differential amplifier, said switching element being connected to said circuit output terminal, said reference potential, and said output terminal of said differential amplifier; a first element (for example, a p-channel transistor P5 in the embodiments of the present invention) having a resistive component, said first element being connected to said power supply voltage and said circuit output terminal; and a second element (for example, a resistors R2 and R3 in the embodiments of the present invention) having a capacitive component, said second element being connected to the above first element. Such a configuration allows the current noise of the power supply voltage to be removed, and the excess current, which transitionally sneaks into the circuit output terminal, to be removed surely and efficiently.

Desirably, said first element is a transistor in the band gap circuit relating to the present invention. This allows the first element having the resistive component to be easily formed.

Also, desirably, said second element is an ion implantation resistor in the band gap circuit relating to the present invention. This allows the power supply noise of the power supply voltage to be surely removed by employing parasitic capacity of the ion implantation resistor.

BRIEF DESCRIPTION OF THE DRAWINGS

This and other objects, features and advantages of the present invention will become more apparent upon a reading of the following detailed description and drawings, in which.

DESCRIPTION OF THE EMBODIMENTS

Hereinafter, embodiments of the present invention will be explained by referring to the accompanied drawings.

The band gap circuit having no low-pass filter, and the band gap circuit having the low-pass filter provided will be explained in the embodiments of the present invention. Additionally, a MOSFET is employed for explanation in the embodiments of the present invention; however it is not limited to the MOSFET, and a unipolar transistor such as a MISFET and a JFET, and a bipolar transistor are also acceptable. Also, additionally, in the embodiments of the present invention, an enhancement-type field effect transistor is employed for explanation; however a depletion-type field effect transistor is also acceptable.

EMBODIMENT 1 OF THE INVENTION

In the embodiment 1 of the present invention (hereinafter, called the embodiment 1 for short), the band gap circuit having no low-pass filter will be explained.

Figure 1:
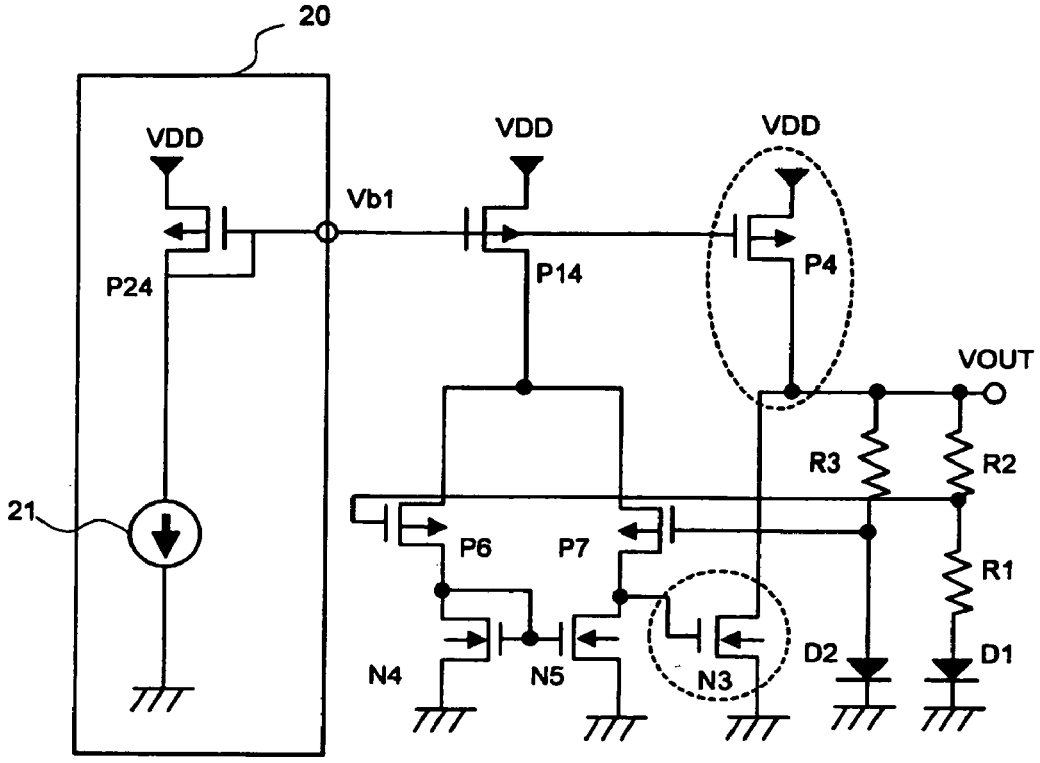
FIG. 1 is a circuit diagram illustrating one configuration example of the band gap circuit in the embodiment 1 of the present invention.

At first, a configuration of the band gap circuit in the embodiment 1 will be explained by employing FIG. 1. FIG. 1 is a schematic circuit diagram illustrating one configuration example of the band gap circuit in the embodiment 1. As shown in FIG. 1, the band gap circuit in the embodiment 1 has the differential amplifier, and the n-channel transistor N3 connected to this differential amplifier. Additionally, hereinafter, the n-channel transistor is called an n-type transistor for short, and the p-channel transistor called a p-type transistor.

The differential amplifier is configured of a general op-amp. As shown in FIG. 1, the differential amplifier of the band gap circuit is configured of one pair of p-type transistors P6 and P7, and one pair of n-type transistors N4 and N5.

A source of the n-type transistor N4 is earthed to the ground that becomes a reference potential, and a drain thereof is connected to the drain of the p-type transistor P6. Also, a gate of the n-type transistor N4 is connected to the gate of the n-type transistor N5. Furthermore, the connection (diode connection) is made between the drain and the gate of the n-type transistor N4. As to the n-type transistor N5, similarly to the n-type transistor N4, its source is earthed to the ground, and its drain is connected to the drain of the p-type transistor P7. Also, the gate of the n-type transistor N5 is connected to the gate of the n-type transistor N4.

The drain of the p-type transistor P6 is connected to the drain of the n-type transistor N4, and the source thereof is connected to the power supply voltage VDD via a p-type transistor P14. Also, as shown in FIG. 1, the gate of the p-type transistor P6 is connected to the output terminal VOUT via the resistor R2. As to the p-type transistor P7, similarly to the p-type transistor P6, its drain is connected to the drain of the n-type transistor N5, and its source is connected to the power supply voltage VDD via the p-type transistor P14. Also, as shown in FIG. 1, the gate of the p-type transistor P7 is connected to the output terminal VOUT via the resister R3. Resistors R2 and R3 have substantially the same resistance value.

As shown in FIG. 1, the resistor R2, the resistor R1, and the diode D1 are connected between the output terminal VOUT and the ground in the order of their being located on the output terminal VOUT side. In addition hereto, the resistor R3 and the diode D2 are connected between the output terminal VOUT and the ground in the order of their being located on the output terminal VOUT side.

A cathode of the diode D1 is earthed to the ground, and its anode is connected to the resistor R1. The resistor R1 has one end thereof connected to the diode D1, and the other connected to the resistor R2 and the gate of the p-type transistor P6. Also, the resistor R2 has one end thereof connected to the resistor R1 and the gate of the p-type transistor P6, and the other connected to the output terminal VOUT.

The cathode of the diode D2 is earthed to the ground, and its anode is connected to the resistor R3 and the gate of the p-type transistor P7. The resistor R2 has one end thereof connected to the resistor R1 and the gate of the p-type transistor P6, and the other connected to the output terminal VOUT.

The resistors R1, R2, and R3, and diodes D1 and D2 are connected between the output terminal VOUT and the ground in such a manner, and the gate of the p-type transistor P6 functions as the noninverting input terminal of the differential amplifier. Together therewith, the gate of the p-type transistor P7 functions as the inverting input terminal of the differential amplifier. The differential amplifier, as a rule, performs the operation so that the noninverting input terminal and the inverting input terminal have the almost identical potential. This operation is utilized to cause the potential of the anode of the diode D2 and the potential of the resister R1 on the power supply side to become equal for generating the constant current.

Also, the resistors R1, R2 and R3 are not limited to the general resistive element, but also can be formed, for example, by employing an element having a resistive component, such as a transistor. Also, the resistors R1, R2, and R3 should be an N well resistor formed on a substrate such as a silicon substrate. Herein, the so-called N well resistor is a diffused resistor wherein the parasitic capacity sticks between the substrate and an N well. Also, the so-called N well resistor is an ion implantation resistor having the N well formed, for example, by means of an ion implantation method. In the event of employing the N well resistor to form the resistors R1, R2 and R3, they can be formed simultaneously in forming the other transistor, whereby the resistor can be formed easily.

As shown in FIG. 1, the n-type transistor N3 is connected to the differential amplifier and to the output terminal VOUT. The gate of the n-type transistor N3 is connected between the n-type transistor N5 and the p-type transistor P7 of the differential amplifier, and is connected to respective drains of the n-type transistor N5 and the p-type transistor P7. Furthermore, the drain of the n-type transistor N3 is connected to the output terminal VOUT. Together therewith, the source of the n-type transistor N3 is connected to the ground.

The n-type transistor N3 has a function of absorbing a transitional sneak current that flows into the output terminal VOUT at the time of introducing the power supply and of fluctuation thereof with the negative feedback of the differential amplifier, which will be described later. That is, the n-type transistor N3 has a function of causing a sneak current of the output terminal VOUT to flow in the ground for removing it by the gate potential rising due to the feedback by the differential amplifier at the moment that the sneak current transitionally flows into the output terminal VOUT at the time of introducing the power supply and of fluctuation thereof. Herein, the so-called sneak current is an excess current that flows into the output terminal VOUT at the time of introducing the power supply and of fluctuation thereof.

Additionally, in FIG. 1, the n-type transistor N3 was directly connected to the differential amplifier; however, the element may be caused to intervene between the n-type transistor N3 and the differential amplifier, which will be described later. Also, additionally, the n-type transistor N3 and the output terminal VOUT were directly connected; however if the sneak current that transitionally flows into the output terminal VOUT can be removed, the element may be caused to intervene between the n-type transistor N3 and the output terminal VOUT. Desirably, the sneak current can be more easily caused to flow into the ground in the event that the element does not exist between the n-type transistor N3 and the output terminal VOUT than that it does exist, whereby the direct connection should be made between the n-type transistor N3 and the output terminal VOUT.

As a rule, in the band gap circuit utilizing an imaginary short of the differential amplifier like the band gap circuit of the embodiment 1, it is more desirable that no offset voltage of the differential amplifier exists than that it does exist. In the event of eliminating the offset voltage of the differential amplifier, respective source potentials and drain potentials of the p-type transistors P6 and P7 are caused to become almost identical. In FIG. 1, the drain potential of the p-type transistors P6 is equal to the potential between the source and the gate of the n-type transistor N4, and the drain potential of the p-type transistors P7 is equal to the potential between the source and the gate of the n-type transistor N3. For this, when a dimension of the n-type transistor N3 is decided so that the potential between the source and the gate of the n-type transistor N4, and the potential between the source and the gate of the n-type transistor N3 becomes equal, the offset voltage of the differential amplifier can be eliminated.

In such a manner, when the dimension of the n-type transistor N3 is decided so that the potential between the source and the gate of the n-type transistor N4, and the potential between the source and the gate of the n-type transistor N3 becomes equal, the offset voltage of the differential amplifier can be eliminated. For this, by deciding only the dimension of the n-type transistor N3, the offset voltage of the differential amplifier can be eliminated easily. This allows the excellent band gap circuit that outputs the output voltage with high precision to be realized easily.

Additionally, in FIG. 1, the gate of the n-type transistor N3 was directly connected between the n-type transistor N5 and the p-type transistors P7 of the differential amplifier; however it is not limited to this, and the element should be caused to intervene between the n-type transistor N3, and the n-type transistor N5 or the p-type transistor P7. At this time, its element, which is caused to intervene, can be taken as an element having no influence upon deciding the dimension of the n-type transistor N3 as mentioned before. That is, even though the element having no influence upon the dimension that decides the n-type transistor N3 is connected between the n-type transistor N3, and the n-type transistor N5 or the p-type transistor P7, if the dimension of the n-type transistor N3 can be decided as mentioned before, it is acceptable. In such a manner, it is included in the fact that the n-type transistor N3 in the present invention is directly connected to the differential amplifier that the element having no influence upon deciding the dimension of the n-type transistor N3 is caused to intervene.

The p-type transistor P4 is connected to the output terminal VOUT. The output terminal VOUT is connected to the drain of the p-type transistor P4, and the source of the p-type transistor P4 is connected to the power supply voltage VDD. The gate of the p-type transistor P4 which is connected to the gate of the p-type transistor P14 is supplied with the bias voltage Vb1 from a constant voltage source 20 via the p-type transistor P14. The p-type transistor P4 supplies the current from the power supply voltage VDD to the output terminal VOUT responding hereto.

As shown in FIG. 1, the gate of p-type transistor P14 is connected to the constant voltage source 20 and the gate of p-type transistor P4. The p-type transistor P14 has the drain thereof connected to the differential amplifier, and the source connected to the power supply voltage VDD. And, the gate of p-type transistor P14 is supplied with the bias voltage Vb1 from the constant voltage source 20. The p-type transistor P14 supplies the current from the power supply voltage VDD to the differential amplifier responding hereto. Also, as shown in FIG. 1, a p-type transistor P24 within the constant voltage source 20 to be described later, the p-type transistor P4, and the p-type transistor P14 configure the current mirror circuit. Additionally, in FIG. 1, the p-type transistor P14 is connected to the differential amplifier.

The constant voltage source 20 is configured with a constant current source 21 and the p-type transistor P24. The constant current source 21 has one end thereof earthed to the ground, and the other connected to the drain of the p-type transistor P24. Also, the source of the p-type transistor P24 is connected to the power supply voltage VDD, and the drain thereof is connected to the constant current source 21. Also, the p-type transistor P24 has the connection (diode connection) made between the drain and the gate thereof. The bias voltage Vb1 for p-type transistors P14 and P4 is output from the drain and the gate of the p-type transistor P24.

Next, an operation of the band gap circuit of the embodiment 1 will be explained by employing FIG. 1. Herein, since the differential amplifier performs the operation similarly to the conventional differential amplifier, its explanation is omitted. When the transitional sneak current does not occur by the introduction of the power supply, and the fluctuation thereof etc., the inverting input terminal and the noninverting input terminal of the differential amplifier perform the operation at almost the same potential similarly to the conventional band gap circuit. The potentials of the gates of the p-type transistors P6 and P7 are kept at almost the same potential. For this, the constant current flows in the n-type transistor N3 without varying in the gate potential of the n-type transistor N3.

To the contrary, when the transitional sneak current occurs due to the introduction of the power supply and the fluctuation thereof etc., being accompanied by its occurrence, the output voltage of the output terminal VOUT, and the gate potentials of the p-type transistors P6 and P7 also fluctuate similarly. At this time, as compared with the gate potential of the p-type transistor P7, the gate potential of the p-type transistor P6 fluctuates largely when the sneak current flows because it has the resistor R1 in a relation of an equation (A) described below.

$$R \times \Delta I = \Delta V \text{ (}R\text{: resistor, } \Delta I\text{: sneak current, and } \Delta V\text{: potential fluctuation):} \quad (A)$$

Due to the fluctuation of the gate potential of this p-type transistors P6 and P7, the drain current of the p-type transistor P6 decrease and the drain current of the p-type transistor P7 increase. Together therewith, when the drain current of the p-type transistor P6 decreases, the n-type transistor N4 acts as an active resistor, whereby the gate potential of the n-type transistor N4 lowers. Also, when the drain current of the p-type transistor P7 increases, the n-type transistor N5 also acts as an active resistor, whereby the gate potential of the n-type transistor N3 rises.

And, when the gate potential of the n-type transistor N3 rises, the drain current of the n-type transistor N3 also increases, and the negative feedback results in being applied to the differential amplifier, thus causing the current to flow between the output terminal VOUT and the n-type transistor N3. Thereby, the n-type transistor N3 causes the sneak current, which transitionally flowed into the output terminal VOUT, to flow in the ground.

When the n-type transistor N3 causes the sneak current of the output terminal VOUT to flow in the ground, the potential of the output terminal VOUT lowers. Being accompanied thereby, the potential difference between the inverting input terminal and the noninverting input terminal of the differential amplifier, which occurred due to the fluctuation of the output terminal VOUT, disappears. And each transistor, the inverting input terminal, the noninverting input terminal of the differential amplifier, and the n-type transistor N3 reach a state of equilibrium. Herein, the so-called state of equilibrium represents that they are at the same potential as an input bias potential.

In such a manner, in the band gap circuit of the embodiment 1, the sneak current of the output terminal VOUT can be caused to flow in the ground via the n-type transistor N3 for efficiently removing it. Furthermore, in the band gap circuit of the embodiment 1, by deciding only the dimension of the n-type transistor N3, the sneak current of the output terminal VOUT can be caused to flow in the ground for removing it efficiently and easily. Also, in the band gap circuit of the embodiment 1, the n-type transistor N3 can be connected to the differential amplifier to remove the sneak current efficiently and easily without greatly increasing the number of the element for removing the sneak current. For this, it becomes possible that the current that sneaks into the output terminal VOUT is efficiently and easily removed, while the low-voltage power supply is employed for driving at a high speed.

Figure 4:
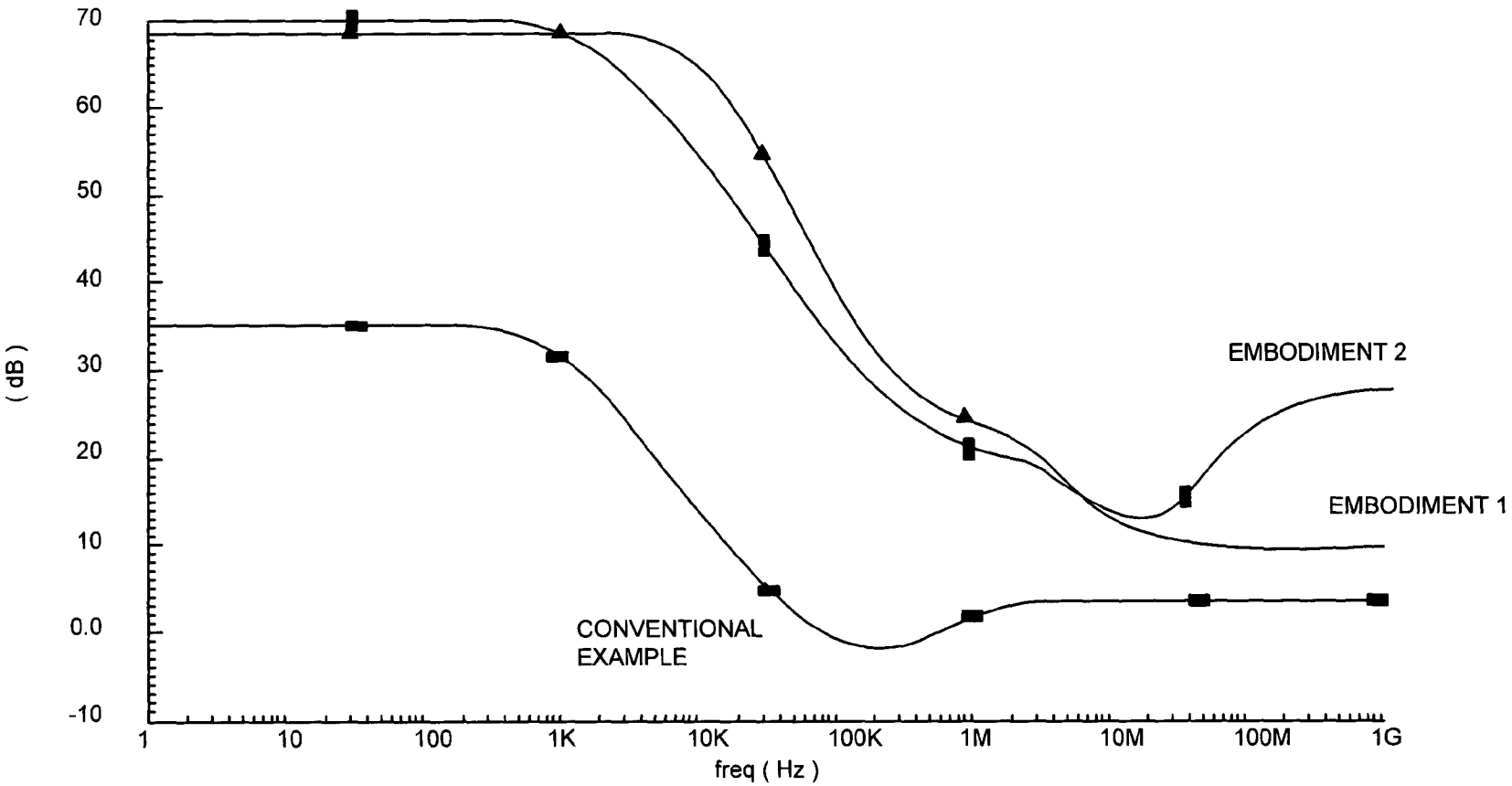
FIG. 4 is one example of the characteristic view illustrating the comparison result of the PSRR relative to the frequency between the band gap circuit in the embodiments of the present invention and the conventional band gap circuit.

FIG. 4, FIG. 5, and FIG. 6 are employed to compare the operation of the band gap circuit of the embodiment 1 with the operation of the conventional differential band gap circuit. FIG. 4 is one example of the characteristic view illustrating the comparison result of the PSRR relative to the frequency between the band gap circuit in the embodiment of the present invention and the conventional band gap circuit. FIG. 5 is one example of the characteristic view illustrating the power supply voltage dependency associated with the conventional band gap circuit. FIG. 6 is one example of the characteristic view illustrating the power supply voltage dependency of the band gap circuit in the embodiment 1. Additionally, herein, the foregoing differential band gap circuit was employed as the conventional band gap circuit.

As shown in FIG. 4, in the conventional band gap circuit, when the frequency of the voltage to be applied to the logic circuit is varied from a low frequency to a high frequency for applying the voltage, the negative feedback ability of the differential amplifier lowers, whereby the PSRR lowers with the frequency of 100 Hz to 1 KHz or something like this at a watershed. Herein, in FIG. 4, the voltage of the power supply is 1.5 V that is applied to the band gap circuit. And, after the PSRR began to lower with the frequency of 100 Hz to 1 KHz or something like this at a watershed, the PSRR is stabilized with the frequency of 1 MHz to 100 MHz or something like this at a watershed. The value of the PSRR stabilized at this time becomes 0 dB to 10 dB or something like this. That is, in the event of employing the conventional band gap circuit to operate the logic circuit at a high speed in the order of GHz, it operates at the PSRR of 0 dB to 10 dB or something like this.

In the band gap circuit of the embodiment 1, as shown in FIG. 4, when the frequency of the power supply voltage VDD of 1.5 V to be applied to the logic circuit is varied from the low frequency to the high frequency for applying the voltage, the negative feedback ability of the differential amplifier lowers similarly to the conventional band gap circuit, whereby the PSRR lowers with the frequency of 100 Hz to 1 KHz or something like this at a watershed.

In the band gap circuit of the embodiment 1, the n-type transistor N3 connected to the differential amplifier causes the transitional sneak current, which flows into the output terminal VOUT, to flow in the ground. For this, the PSRR in the band gap circuit of the embodiment 1 can be constantly kept at a high value as compared with the PSRR in the conventional band gap circuit. In particular, in the band gap circuit of the embodiment 1, the n-type transistor N3 causes the sneak current to flow in the ground at the time of introducing the power supply, whereby the PSRR can be kept at higher value than that of the conventional band gap circuit immediately after introducing the power supply.

And, after the PSRR began to lower with the frequency of 100 Hz to 1 KHz or something like this at a watershed, it is stabilized. At this time, at the moment that the PSRR lowers, the PSRR of the band gap circuit of the embodiment 1 lowers by a higher value than that of the conventional band gap circuit, and begins to be stabilized with the frequency of 1 MHz to 100 MHz or something like this at a watershed. The PSRR after stabilization is 10 dB to 20 dB or something like this because the PSRR in the band gap circuit of the embodiment 1 is constantly kept at a high value as compared with that of the conventional band gap circuit, which is higher than that of the conventional band gap circuit.

In such a manner, in the band gap circuit of the embodiment 1, the n-type transistor N3 connected to the differential amplifier functions, being accompanied by the introduction of the power supply, whereby, immediately after introducing the power supply, the transitional sneak current into the output terminal VOUT can be efficiently removed by causing it to flow in the ground by the n-type transistor N3. This allows the value of the PSRR of the band gap circuit to be constantly kept at a high value, whereby the PSRR can be enhanced in the high-frequency region in the order of GHz, even in the event of operating the logic circuit at a high speed in the order of GHz.

Furthermore, as shown in FIG. 4, in the band gap circuit of the embodiment 1, differently from the conventional band gap circuit, at the moment that the PSRR lowers due to a decline in the feedback ability of the differential amplifier, the n-type transistor N3 functions, being accompanied by the introduction of the power supply, whereby the PSRR lowers while it is kept at a high value, and comes into a stable condition. This allows not only the PSRR of the high-frequency region, but also the PSRR in the low-frequency region and the intermediate-frequency region to be maintained at a high value.

Figure 5A:
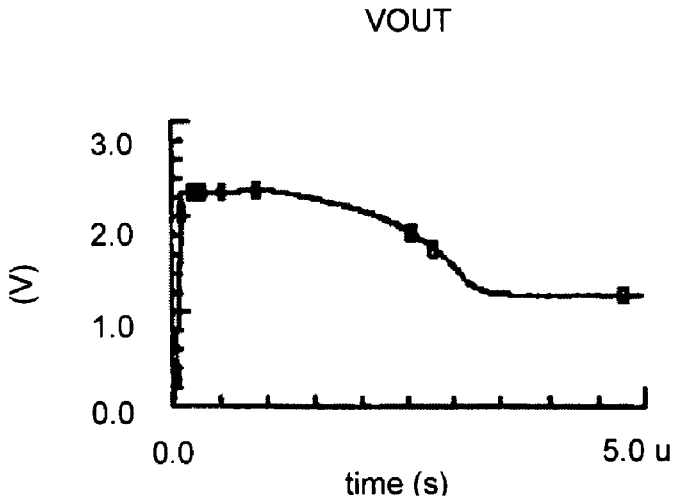
FIG. 5A PRIOR ART
FIG. 5A and FIG. 5B are one example of the characteristic view illustrating the power supply voltage dependency associated with the conventional band gap circuit.
Figure 5B:
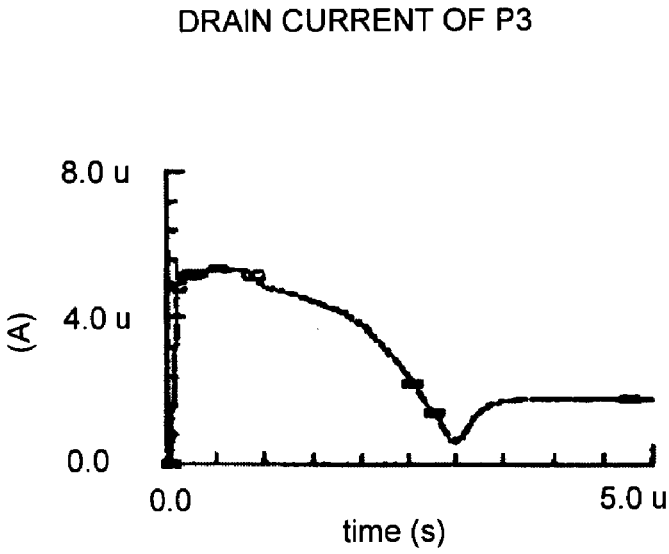
FIG. 5B PRIOR ART

FIG. 5A illustrates the output voltage for a time series at the output terminal VOUT of the conventional band gap circuit. FIG. 5B illustrates the drain current for a time series of the p-type transistor P3 in having applied the power supply voltage VDD to the band gap circuit of the embodiment 1. This represents an impulse response of the output terminal VOUT to the power supply voltage VDD in the band gap circuit of the embodiment.

Figure 6A:
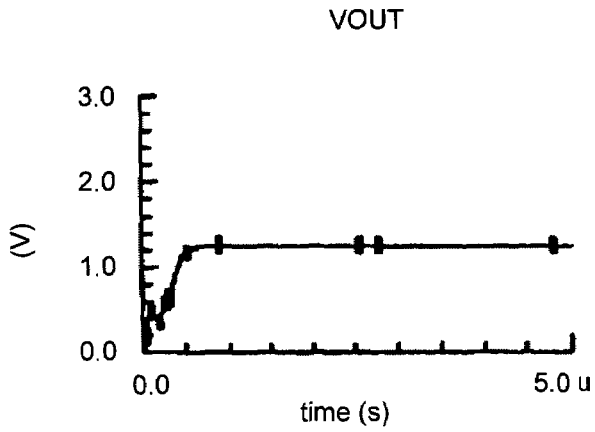
FIG. 6A, FIG. 6B and FIG. 6C are one example of the characteristic view illustrating the power supply voltage dependency of the band gap circuit in the embodiment 1 of the present invention.
Figure 6B:
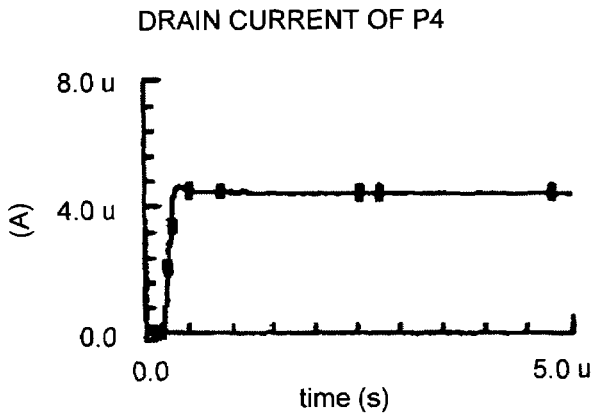
Figure 6C:
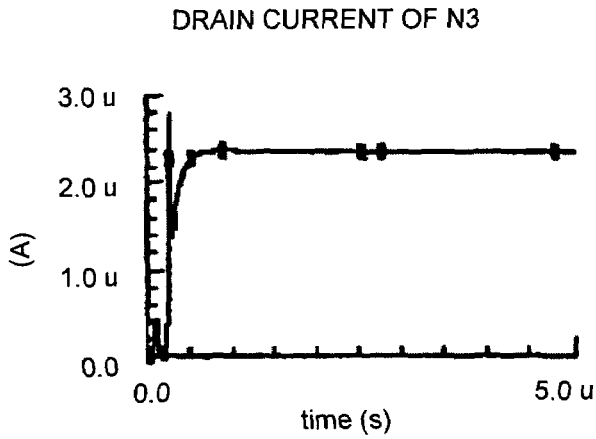

FIG. 6A is one example of the characteristic view illustrating the output voltage relative to a time series at the output terminal VOUT in the band gap circuit of the embodiment 1. FIG. 6B is one example of the characteristic view illustrating the drain current of the p-type transistor P4 relative to a time series in having applied the power supply voltage VDD to the band gap circuit of the embodiment 1. This represents an impulse response of the output terminal VOUT to the power supply voltage VDD in the band gap circuit of the embodiment 1. FIG. 6C illustrates the drain current of the n-type transistor N3 relative to a time series in having applied the power supply voltage VDD to the band gap circuit of the embodiment 1. Additionally, herein, the foregoing differential band gap circuit was employed as the conventional band gap circuit.

In the conventional band gap circuit, when the power supply is introduced into the band gap circuit, the drain current flows in the p-type transistor P3. At this time, as shown in FIG. 5B, by accompanied by the introduction of the power supply, the drain current of the p-type transistor P3 is raised. And, the current flows in the output terminal VOUT due to the drain current of the p-type transistor P3. As shown in FIG. 5A, the transitional sneak current at the time of introducing the power supply flows into the output terminal VOUT, thereby, causing the voltage of the output terminal VOUT to rise.

When the voltage of the output terminal VOUT rises, the sneak current is discharged at the resistors R1, R2, and R3, and the diodes D1 and D2. As shown in FIG. 5A, when the sneak current is discharged by the resistors R1, R2, and R3, and the diodes D1 and D2 etc. and is reduced, the voltage of the output terminal VOUT lowers and then is stabilized. Together therewith, as shown in FIG. 5B, the drain current of the p-type transistor P3 lowers and then is stabilized.

In such a manner, in the conventional band gap circuit, the resistor and the diode that discharge the sneak current that flows into the output terminal VOUT, as a rule, are poor in the discharging ability, whereby the voltage of the output terminal VOUT rises at the time of introducing the power supply. Furthermore, the discharging ability of the resistor and the diode is poor, whereby the resistor and the diode can discharge the drain current only gradually, and the stability time by which the output terminal is stabilized is extended.

In the band gap circuit of the embodiment 1, when the power supply is introduced into the band gap circuit, the drain current flows in the p-type transistor P4. And, the current flows in the output terminal VOUT due to the drain current of the p-type transistor P4. At this time, the gate potential of the n-type transistor N3 rises due to the potential fluctuation of the output terminal VOUT, thus causing the sneak current, which transitionally flows into the output terminal VOUT, to flow in the drain of the n-type transistor N3, and then in the ground. For this, as shown in FIG. 6C, the drain current of the n-type transistor N3 steeply rises.

When the sneak current is caused to flow in the ground by the n-type transistor N3, as shown in FIG. 6B, the drain current of the p-type transistor P4 is gently stabilized and becomes a constant current without rising. Being accompanied thereby, as shown in FIG. 6A, the voltage of the output terminal VOUT is stabilized without rising.

In such a manner, in the band gap circuit of the embodiment 1, the transitional sneak current that flows into the output terminal VOUT is caused to flow in the ground by the n-type transistor N3, whereby the voltage of the output terminal VOUT is stabilized at a constant voltage without rising at the time of introducing the power supply. This allows the stability time by which the voltage of the output terminal VOUT is stabilized to be curtailed, and the band gap circuit suitable for the high-speed operation to be obtained.

As mentioned above, in the band gap circuit of the embodiment 1, the transitional sneak current, which flows into the output terminal VOUT at the time of introducing the power supply and of fluctuation thereof, is caused to flow in the ground immediately by the n-type transistor N3 connected to the differential amplifier. This allows the sneak current, which occurs due to the introduction of the power supply and to the fluctuation thereof, to be removed efficiently.

Furthermore, in the band gap circuit of the embodiment 1, the n-type transistor N3 connected to the differential amplifier causes the sneak current, which transitionally flows into the output terminal VOUT at the time of introducing the power supply and of fluctuation thereof, to flow in the ground efficiently, whereby the stability time by which the voltage of the output terminal VOUT is stabilized can be curtailed. This allows the band gap circuit suitable for the high-speed operation to be configured, and the band gap circuit having a short stability time and a high PSRR to be realized.

Furthermore, also, in the band gap circuit of the embodiment 1, by deciding the dimension of the n-type transistor N3, the offset voltage of the differential amplifier can be easily eliminated. For this, the offset voltage of the differential amplifier can be easily eliminated to easily operate the differential amplifier in a good condition. This allows the band gap circuit, which has a short stability time and a high PSRR, and yet outputs the output voltage with high precision, to be realized easily.

And, in the band gap circuit of the embodiment 1, the n-type transistor N3 can be connected to the differential amplifier to efficiently and easily remove the sneak current without increasing the number of the element for removing the sneak current. For this, it becomes possible to efficiently and easily remove the current that sneaks into the output terminal VOUT, and to employ the low-voltage power supply for driving at a high speed.

THE EMBODIMENT 2 OF THE INVENTION

In the embodiment 2 of the invention (hereinafter, called the embodiment 2 for short), the band gap circuit having a low-pass filter provided will be explained.

Figure 2:
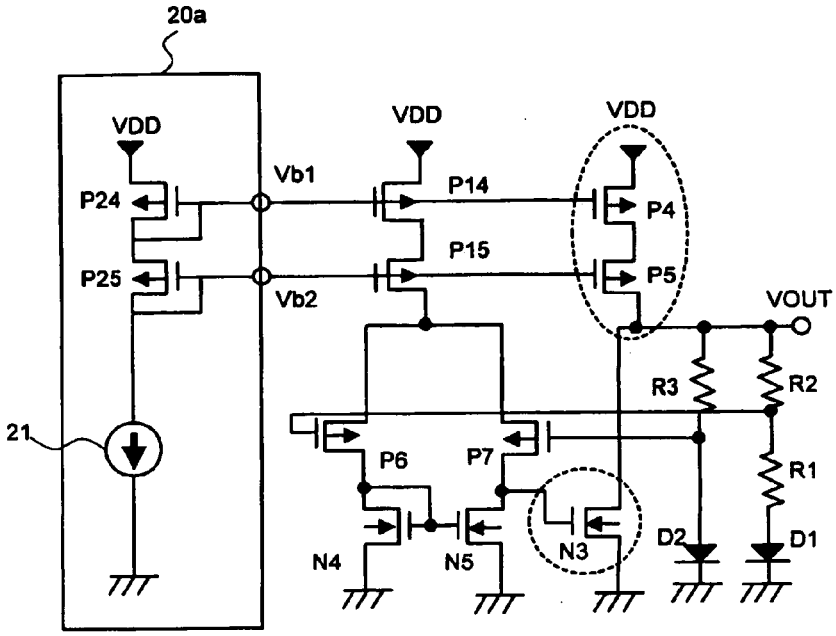
FIG. 2 is a circuit diagram illustrating one configuration example of the reference voltage generator in the embodiment 2 of the present invention.

At first, a configuration of the band gap circuit in the embodiment 2 will be explained by employing FIG. 2. FIG. 2 is a schematic circuit diagram illustrating one configuration example of the band gap circuit in the embodiment 2. As shown in FIG. 2, the band gap circuit in the embodiment 2 is configured similarly to the band gap circuit in the embodiment 1. And, the band gap circuit in the embodiment 2 has the p-type transistor P5 further connected between the output terminal VOUT of the band gap circuit and the p-type transistor P4. Additionally, herein, is omitted the explanation on the differential amplifier, the n-type transistor N3, the p-type transistor P4, etc. that are similar to that of the embodiment 1.

The p-type transistor P5 has the drain thereof connected to the output terminal VOUT, and the source connected to the drain of the p-type transistor P4. The drain of the p-type transistor P4 was connected to the output terminal VOUT in the band gap circuit in the embodiment 1; however it is connected to the source of the p-type transistor P5 in the band gap circuit of the embodiment 2. Furthermore, as shown in FIG. 2, the p-type transistor P5 is connected to the output terminal VOUT, and is connected to the resistors R2 and R3 via the output terminal VOUT.

As shown in FIG. 2, the gate of the p-type transistor P5 is supplied with bias voltage Vb2 from a constant voltage source 20*a* via the p-type transistor P15. The gate of p-type transistor P5 is supplied with bias voltage Vb2 from the constant voltage source 20*a*. Responding the bias voltage Vb2, the p-type transistor P5 supplies the current from the power supply voltage VDD to the output terminal VOUT. At the same time, the p-type transistor P4 supplies the same current to the p-type transistor P5 in response to the bias voltage Vb1 from the constant voltage source 20*a*.

The constant voltage source 20*a*, to which the gate of the p-type transistor P5 is connected, is configured similarly to that of the embodiment 1. The constant voltage source 20*a* of the embodiment 2 has a constant current source 21, a p-type transistor P24, and further has a p-type transistor P25 to be connected to the p-type transistor P5. The p-type transistor P25 has the drain thereof connected to the constant current source 21, and the source connected to the drain of the p-type transistor P24. The drain of the p-type transistor P24 was connected to the constant current source 21 in the band gap circuit of the embodiment 1; however it is connected to the source of the p-type transistor P25 in the band gap circuit of the embodiment 2. Also, the p-type transistor P25 has the connection (diode connection) made between the drain and the gate thereof similarly to the p-type transistor P24.

The gate of the p-type transistor P25 is supplied with the bias voltage Vb2 from the constant voltage source 20*a*, and is connected to the gate of the p-type transistor P5. Together therewith, the gate of the p-type transistor P25 is connected to the gate of the p-type transistor P15. And, the gate of the p-type transistor P24 is supplied with the bias voltage Vb1 from the constant voltage source 20*a*, and is connected to the gates of both the p-type transistors P4 and P14. Additionally, the p-type transistor P24 of the constant voltage source 20*a* is connected to the p-type transistors P14 and P4 to configure the current mirror circuit. Also, the p-type transistor P25 of the constant voltage source 20*a* is connected to the p-type transistors P15 and P5 to configure the current mirror circuit.

In FIG. 2, the p-type transistor P15 is connected to the differential amplifier. The p-type transistor P15 is cascaded to the p-type transistor P14, and both are connected in series between the differential amplifier and the power supply voltage VDD. The source of the p-type transistor P15 is connected to the drain of the p-type transistor P14, and the drain thereof is connected to the differential amplifier. The drain of this p-type transistor P15 is connected to the source of the p-type transistors P6 and P7 of the differential amplifier. Furthermore, the gate of the p-type transistor P15 is connected to the gate of the p-type transistor P5, and is supplied with the bias voltage Vb2 from the constant voltage source 20*a*. The gate of the p-type transistors P14 and P15 receives the bias voltage Vb1 and Vb2 respectively to supply the current from the power supply voltage VDD to the differential amplifier.

As shown in FIG. 2, in the event that the p-type transistors P14 and P15 were cascaded for making the connection to the differential amplifier, the current can be supplied to the differential amplifier in a good condition, and the differential amplifier can be operated accurately.

In the band gap circuit of the embodiment 2, as shown in FIG. 2, the p-type transistor P5, and the resistors R2 and R3 on the output terminal VOUT side are connected via the output terminal VOUT. This allows the p-type transistor P5, and the resistors R2 and R3 on the output terminal VOUT side to function as a low-pass filter. The low-pass filter is configured of the p-type transistor P5 having the resistive component, and the resistors R2 and R3 having the capacitive component. Resistors R2 and R3 have substantially the same resistance value.

For example, in the band gap circuit of the embodiment 2, the p-type transistor P5 is capable of functioning as a resistive element having the resistive component that corresponded to a decline in the voltage between the source and the drain of the p-type transistor P5. Also, in the event that the resistors R2 and R3 on the output terminal VOUT side are N well resistors formed on the substrate such as the p-type silicon substrate, the resistors R2 and R3 function as a capacitive element having the capacitive component that corresponded to the parasitic capacity that sticks between the substrate and the N well.

Figure 3:
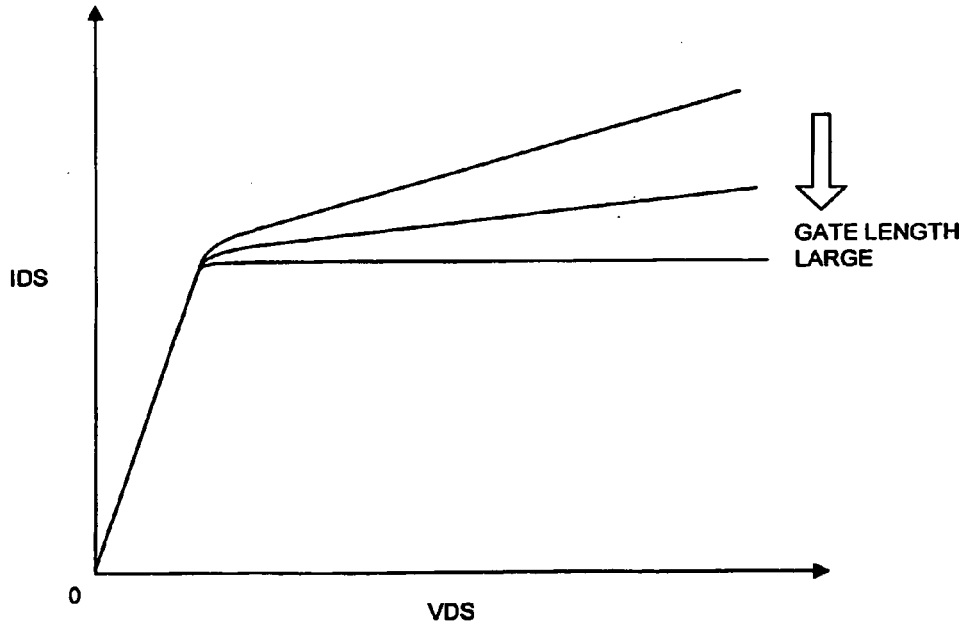
FIG. 3 is one example of the characteristic view illustrating the current/voltage characteristic of the p-type transistor of the band gap circuit in the embodiment 2 of the present invention.

Herein, the so-called N well resistor is a diffused resistor wherein the parasitic capacity sticks between the substrate and the N well, and also is an ion implantation resistor having the N well formed, for example, by means of the ion implantation method. For this, by employing the N well formed by means of the ion implantation method etc. as the resistors R2 and R3 on the output terminal VOUT side, the low-pass filter can be configured. In the event of employing the N well resistor to form the resistors R2 and R3 in such a manner, it can be formed simultaneously in forming the other transistor, and the resistor having the capacitive component can be formed easily Also, as a rule, when a gate length of the p-type transistor P5 is lengthened, as shown in FIG. 3, the current characteristic of the source-drain can be stabilized, and the situation can be extended in which the current is kept constant against the voltage. And, by lengthening the gate length of the p-type transistor P5, it can be employed as a resistive element having the resistive component. For this, in the event of configuring the low-pass filter of the p-type transistor P5 and the resistors R2 and R3 on the output terminal VOUT side, the gate length of the p-type transistor P5 is desirably lengthened. As one example, the gate length of the p-type transistor P5 is preferably taken as 2 μm or more.

In such a manner, by employing the N well resistor for the resistors R2 and R3 on the output terminal VOUT side, the parasitic capacity can be positively utilized to configure the low-pass filter that removes the noise having the frequency higher than a certain level. This allows the power supply noise of the high-frequency region to be included in the current from the power supply voltage VDD to be surely removed in the band gap circuit of the embodiment 2.

Additionally, the p-type transistor P5 was provided for configuring the low-pass filter in the band gap circuit of the embodiment 2; however it is not limited to this, and the element having the resistive component such as the transistor and the resistor is acceptable. By employing the p-type transistor P5 as the element having the resistive component like it is employed in the band gap circuit of the embodiment 2, the element having the resistive component can be formed easily and efficiently. Also, since the p-type transistor P5 of the band gap circuit of the embodiment 2 requires a large resistance value in 1 MΩ or more, the transistor is preferably employed as the element having the resistive component.

Also, additionally, the resistors R2 and R3 on the output terminal VOUT side were taken as N well resistors for configuring the low-pass filter in the band gap circuit of the embodiment 2; however it is not limited to this, and the element having the parasitic resistance and the element having the capacitive component such as the capacity are acceptable. Or, the element having the capacitive component may be provided between the output terminal VOUT and the resistors R2 and R3 on the output terminal VOUT side in addition to the resistors R2 and R3. Also or the low-pass filter may be configured by taking the resistors R2 and R3 on the p-type transistor P5 side as the N well resistor. By employing the resistors R2 and R3 having the parasitic resistance as the element having the capacitive component like it is employed in the band gap circuit of the embodiment 1, the element having the capacitive component can be formed easily and efficiently. Furthermore, by employing the resistors R2 and R3 having the parasitic resistance for both of the resistors R2 and R3 on the output terminal VOUT side and on the p-type transistor P5 side, the function as the low-pass filter can be enhanced.

The operation of the band gap circuit of the embodiment 2 will be explained. The operation is performed in the band gap circuit of the embodiment 2 similarly to the band gap circuit of the embodiment 1. As mentioned before, in the band gap circuit of the embodiment 2, the p-type transistor P5 is connected between the output terminal VOUT of the band gap circuit and the p-type transistor P4 to configure the low-pass filter of the p-type transistor P5 and the resistor R2 on the output terminal VOUT side. For this, at the moment that the power supply voltage VDD was supplied, the power supply noise is removed with this low-pass filter. Additionally, herein, since the operation is performed in the band gap circuit of the embodiment 2 similarly to the band gap circuit of the embodiment 1, its explanation is omitted.

The operation of the band gap circuit of the embodiment 2 is compared with that of the conventional differential band gap circuit by employing FIG. 4, FIG. 5, and FIG. 7. FIG. 4 is one example of the characteristic view illustrating the comparison result of the PSRR relative to the frequency between the band gap circuit in the embodiment of the present invention and the conventional band gap circuit. FIG. 5 is one example of the characteristic view illustrating the power supply voltage dependency associated with the conventional band gap circuit. FIG. 7 is one example of the characteristic view illustrating the power supply voltage dependency of the band gap circuit in the embodiment 2. Additionally, herein, the foregoing differential band gap circuit was employed as the conventional band gap circuit.

As shown in FIG. 4, in the conventional band gap circuit, when the frequency of the voltage to be applied to the logic circuit is varied from the low frequency to the high frequency for applying the voltage, the negative feedback ability of the differential amplifier lowers, whereby the PSRR lowers with the frequency of 100 Hz to 1 KHz or something like this at a watershed. Herein, in FIG. 4, the voltage of the power supply is 1.5 V that is applied to the band gap circuit. And, after the PSRR began to lower with the frequency of 100 Hz to 1 KHz or something like this at a watershed, it is stabilized with the frequency of 1 MHz to 100 MHz or something like this at a watershed. The value of the PSRR stabilized at this time becomes 0 dB to 10 dB or something like this. That is, in the event of employing the conventional band gap circuit to operate the logic circuit at a high speed in the order of GHz, it operates at the PSRR of 0 dB to 10 dB or something like this.

In the band gap circuit of the embodiment 2, as shown in FIG. 4, when the frequency of the power supply voltage VDD of 1.5 V to be applied to the logic circuit is varied from the low frequency to the high frequency for applying the voltage, the negative feedback ability of the differential amplifier lowers similarly to the conventional band gap circuit, whereby the PSRR lowers with the frequency of 100 Hz to 1 KHz or something like this at a watershed.

In the band gap circuit of the embodiment 2, similar to the band gap circuit of the embodiment 1, the n-type transistor N3 connected to the differential amplifier causes the transitional sneak current, which flows into the input terminal VOUT, to flow in the ground. For this, the PSRR in the band gap circuit of the embodiment 2 can be constantly kept at a high value as compared with the PSRR in the conventional band gap circuit. In particular, in the band gap circuit of the embodiment 2, the n-type transistor N3 causes the sneak current to flow in the ground at the time of introducing the power supply, whereby the PSRR higher than that of the conventional band gap circuit can be realized immediately after introducing the power supply.

And, after the PSRR began to lower with the frequency of 100 Hz to 1 KHz or something like this at a watershed, the PSRR is stabilized. At this time, similarly to the band gap circuit of the embodiment 1, at the moment that the PSRR lowers, it lowers by a higher value than that of the conventional band gap circuit, and begins to be stabilized with the frequency of 1 MHz to 100 MHz or something like this at a watershed.

Furthermore, in the band gap circuit of the embodiment 2, the low-pass filter for removing the power supply noise in the high-frequency region of the power supply voltage VDD is configured of the p-type transistor P5 and the resistors R2 and R3 of the output terminal VOUT. For this, differently from the P5RR of the conventional band gap circuit, and the band gap circuit of the embodiment 1, at the moment that the PSRR is stabilized after it lowered, the PSRR in the band gap circuit of the embodiment 2 gently rises. The PSRR after stabilization becomes 20 dB to 30 dB or something like this because the PSRR in the band gap circuit of the embodiment 2 is constantly kept at a higher value than that of the conventional band gap circuit, which is a higher value than that of the conventional band gap circuit.

In such a manner, in the band gap circuit of the embodiment 2, similarly to the band gap circuit of the embodiment 1, the n-type transistor N3 connected to the differential amplifier functions, being accompanied by the introduction of the power supply, whereby the transitional sneak current into the output terminal VOUT can be efficiently removed by causing it to flow in the ground by the n-type transistor N3 immediately after introduction of the power supply. This allows the value of the PSRR of the band gap circuit to be constantly kept at a high value, whereby the PSRR can be enhanced in the high-frequency region in the order of GHz, even in the event of operating the logic circuit at a high speed in the order of GHz.

As shown in FIG. 4, in the band gap circuit of the embodiment 2, differently from the band gap circuit of the embodiment 1, the n-type transistor N3 is connected to the differential amplifier, and the p-type transistor P5 is connected to the output terminal VOUT. The low-pass filter to be connected to the power supply voltage VDD is configured of this p-type transistor P5 and resistors R2 and R3 on the output terminal VOUT side, thus allowing the current noise, which is apt to occur in the high-frequency region, to be surely removed. For this, it becomes possible that the PSRR is raised in the high-frequency region for stabilizing it at a higher value than that of the case of the embodiment 1.

Figure 7A:
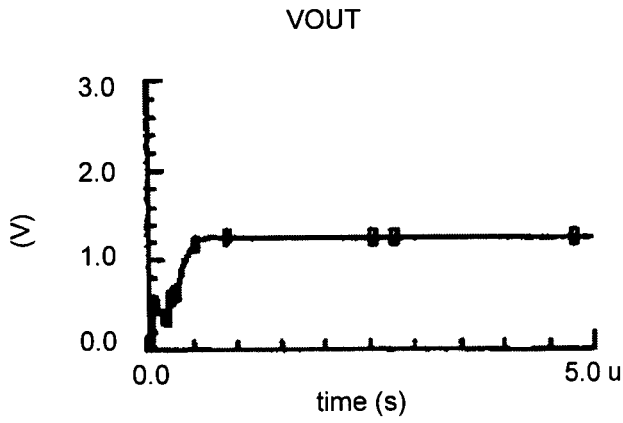
FIG. 7A, FIG. 7B and FIG. 7C are one example of the characteristic view illustrating the power supply voltage dependency of the band gap circuit in the embodiment 2 of the present invention.
Figure 7B:
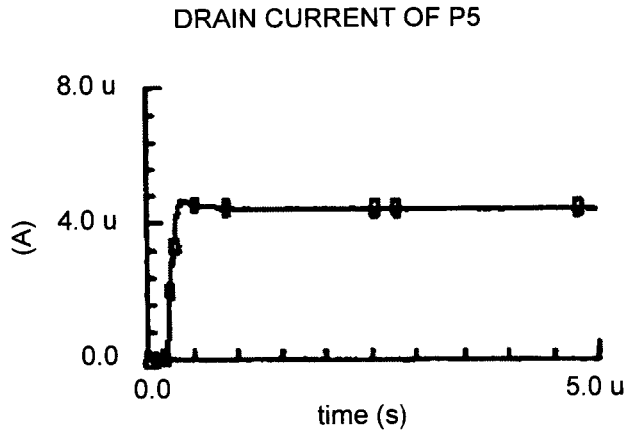
Figure 7C:
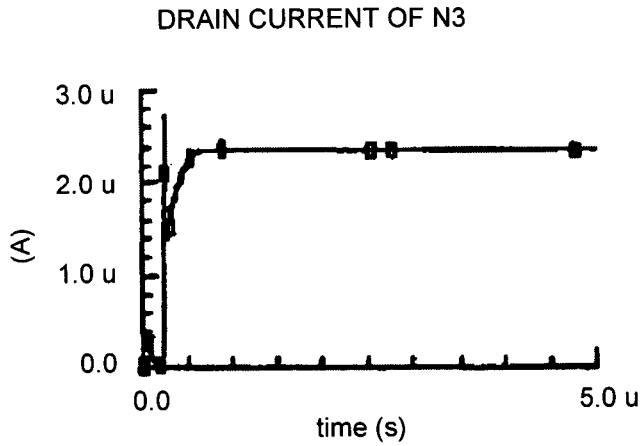
Figure 8:
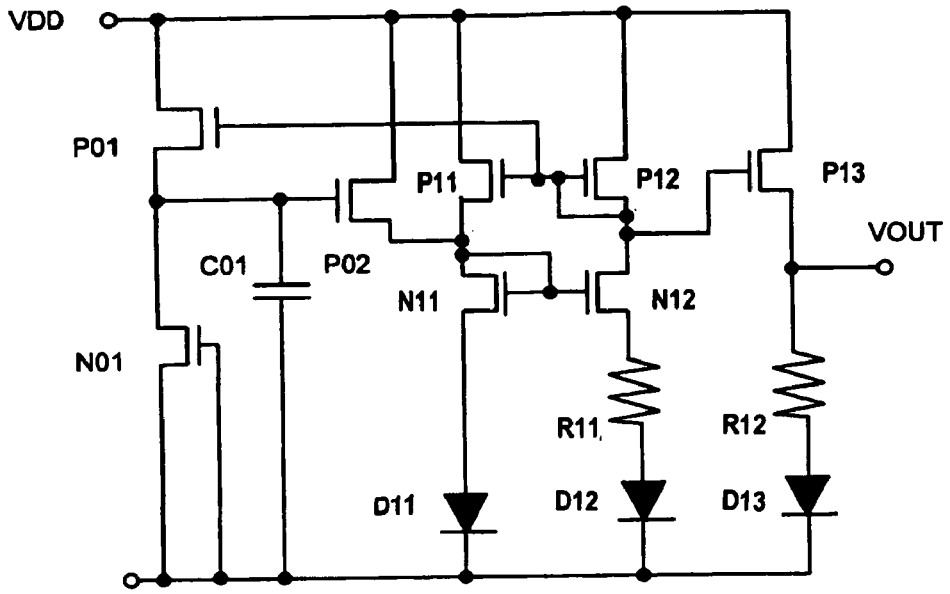
FIG. 8 PRIOR ART
FIG. 8 is a circuit diagram illustrating one configuration example of the conventional current-mirror band gap circuit.
Figure 9:
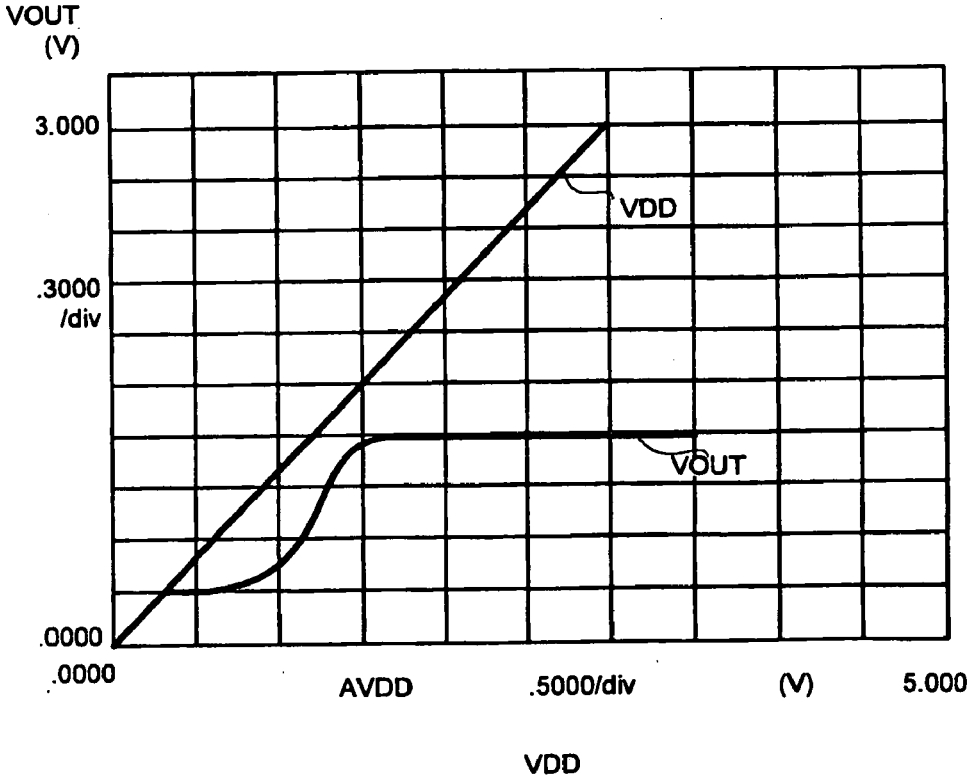
FIG. 9 PRIOR ART
FIG. 9 is one example of the characteristic view illustrating the power supply voltage dependency in the conventional current-mirror band gap circuit.
Figure 10:
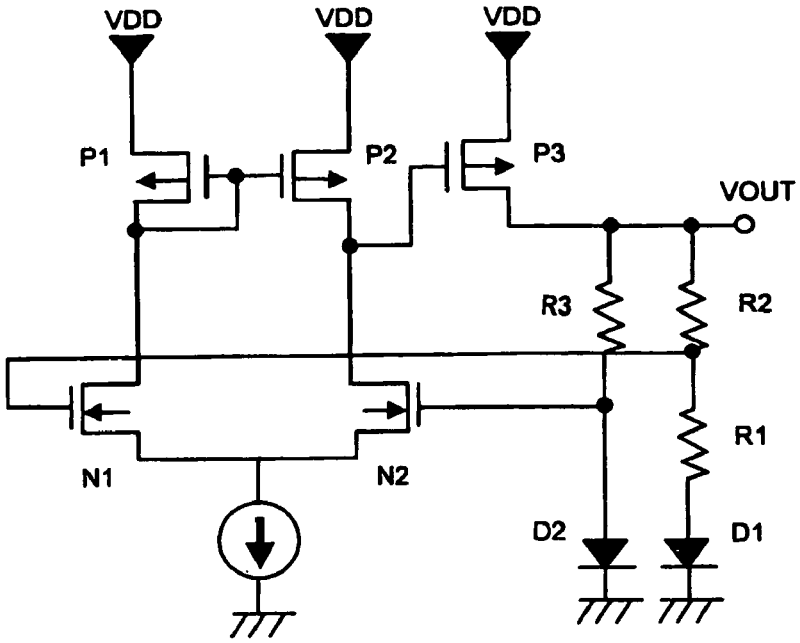
FIG. 10 PRIOR ART
FIG. 10 is a circuit diagram illustrating one configuration example of the conventional differential band gap circuit and FIG. 11 is one example of the characteristic view illustrating the power supply voltage dependency in the conventional differential band gap circuit.
Figure 11:
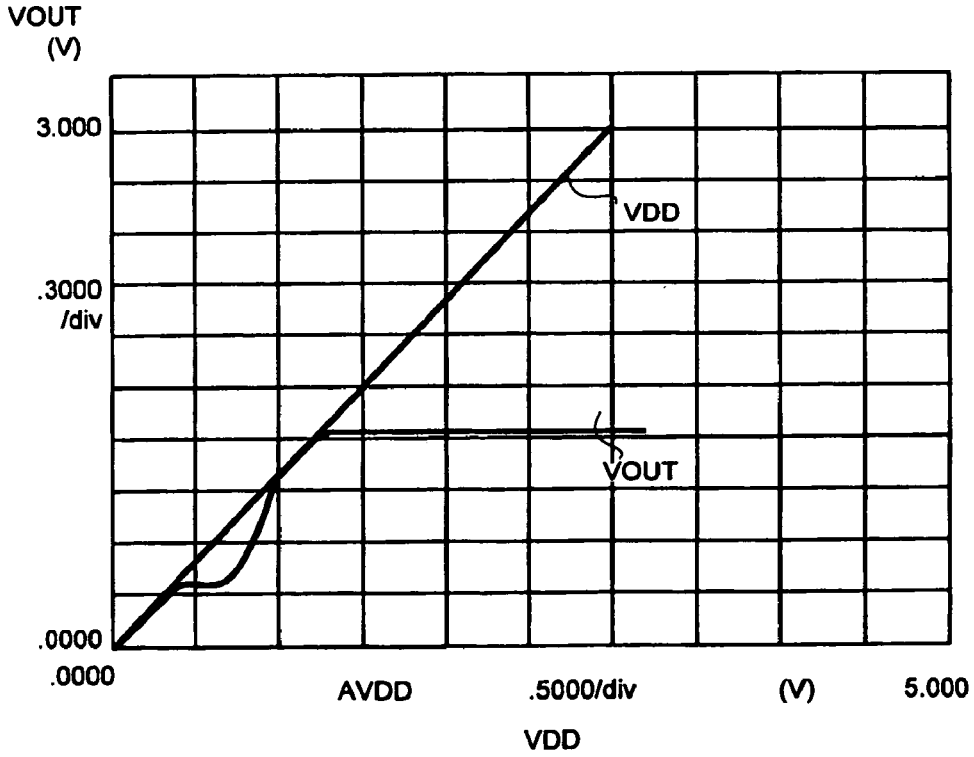
FIG. 11 PRIOR ART

FIG. 7A is one example of the characteristic view illustrating the output voltage relative to a time series at the output terminal VOUT in the band gap circuit of the embodiment 2. FIG. 7B is one example of the characteristic view illustrating the drain current of the p-type transistor P5 relative to a time series in having applied the power supply voltage VDD to the band gap circuit of the embodiment 2. This represents the impulse response of the output terminal VOUT to the power supply voltage VDD in the band gap circuit of the embodiment 2. FIG. 7C illustrates the drain current of the n-type transistor N3 relative to a time series in having applied the power supply voltage VDD to the band gap circuit of the embodiment 2. Additionally, herein, the foregoing differential band gap circuit was employed as the conventional band gap circuit.

In the conventional band gap circuit, when the power supply is introduced into the band gap circuit, the drain current flows in the p-type transistor P3. At this time, as shown in FIG. 5B, being accompanied by the introduction of the power supply, the drain current of the p-type transistor P3 is raised. And, the current flows in the output terminal VOUT due to the drain current of the p-type transistor P3. As shown in FIG. 5A, the transitional sneak current at the time of introducing the power supply flows into the output terminal VOUT, thereby, causing the voltage of the output terminal VOUT to rise.

When the voltage of the output terminal VOUT rises, the sneak current is discharged at the resistors R1, R2, and R3, and the diodes D1 and D2. Also, as shown in FIG. 5B, the sneak current flows into the p-type transistor P3 as well, thus causing the drain current to rise further from the rising level caused by the introduction of the power supply. Thereafter, as shown in FIG. 5A, when the sneak current is discharged by the resistors R1, R2, and R3, and the diodes D1 and D2 etc. and is reduced, the voltage of the output terminal VOUT lowers and then is stabilized. Together therewith, as shown in FIG. 5B, the drain current of the p-type transistor P3 lowers and then is stabilized.

In such a manner, in the conventional band gap circuit, the discharging ability of the resistor and the diode that discharge the sneak current that flows into the output terminal VOUT is poor, whereby the voltage of the output terminal VOUT rises at the time of introducing the power supply. Furthermore, as a rule, the resistor and the diode are poor in the discharging ability, whereby the resistor and the diode can discharge the current only gradually, and the stability time by which the voltage of the output terminal is stabilized is extended.

In the band gap circuit of the embodiment 2, when the power supply is introduced into the band gap circuit, the drain current flows in the p-type transistors P4 and P5. And, the current flows in the output terminal VOUT due to the drain current of the p-type transistors P4 and P5. At this time, the gate potential of the n-type transistor N3 rises due to the voltage fluctuation of the output terminal VOUT, thus causing the sneak current, which transitionally flows into the output terminal VOUT, to flow in the drain of the n-type transistor N3, and then in the ground. For this, as shown in FIG. 7C, the drain current of the n-type transistor N3 steeply rises.

Furthermore, in the band gap circuit of the embodiment 2, the p-type transistor P5 is connected to the output terminal VOUT to configure the low-pass filter together with the resistors R2 and R3 on the output terminal VOUT side. For this, the power supply noise is removed in the high-frequency region of the power supply voltage VDD with the low-pass filter in supplying the current to the output terminal VOUT.

When the sneak current, of which the power supply noise in the high-frequency region of the power supply voltage VDD was removed with the low-pass filter, is caused to flow by the n-type transistor N3, as shown in FIG. 7B, the drain current of the p-type transistor P5 is gently stabilized and becomes a constant current without rising. Being accompanied thereby, as shown in FIG. 7A, the voltage of the output terminal VOUT is stabilized without rising.

In such a manner, in the band gap circuit of the embodiment 2, the transitional sneak current that flows into the output terminal VOUT is caused to flow in the ground by the n-type transistor N3, whereby the voltage of the output terminal VOUT is stabilized at a constant voltage without rising at the time of introducing the power supply. This allows the stability time by which the voltage of the output terminal VOUT is stabilized to be curtailed, and the band gap circuit suitable for the high-speed operation to be obtained.

Furthermore, in the band gap circuit of the embodiment 2, the power supply noise in the high-frequency region is surely removed with the low-pass filter, whereby the power supply noise in the high-frequency region of the power supply voltage VDD is not included in the sneak current that flows into the output terminal VOUT. For this, the sneak current can be efficiently removed by means of the low-pass filter and the n-type transistor N3, thus enabling curtailment of the stability time by which the voltage of the output terminal VOUT is stabilized all the more. Also, the power supply noise in the high-frequency region of the power supply voltage VDD is removed with the low-pass filter, whereby the voltage can be fetched from the output terminal VOUT in a good condition.

As mentioned above, in the band gap circuit of the embodiment 2, the sneak current, which transitionally flows into the output terminal VOUT at the time of introducing the power supply and of fluctuation thereof, is caused to flow in the ground immediately by the n-type transistor N3 connected to the differential amplifier. This allows the sneak current, which occurs due to the introduction of the power supply and to the fluctuation thereof, to be removed efficiently.

Furthermore, in the band gap circuit of the embodiment 2, the n-type transistor N3 connected to the differential amplifier causes the sneak current, which transitionally flows into the output terminal VOUT at the time of introducing the power supply and of fluctuation thereof, to flow in the ground efficiently, whereby the stability time by which the voltage of the output terminal VOUT is stabilized can be curtailed. This allows the band gap circuit suitable for the high-speed operation to be configured, and the band gap circuit having a short stability time and a high PSRR to be realized.

Furthermore, also, in the band gap circuit of the embodiment 2, by deciding the dimension of the n-type transistor N3, the offset voltage of the differential amplifier can be easily eliminated. For this, the offset voltage of the differential amplifier can be easily eliminated to easily operate the differential amplifier in a good condition. This allows the band gap circuit, which has a short stability time and a high PSRR, and yet outputs the output voltage with high precision, to be realized easily.

And, in the band gap circuit of the embodiment 2, the n-type transistor N3 can be connected to the differential amplifier to remove the sneak current efficiently and easily without increasing the number of the element for removing the sneak current. For this, it becomes possible to efficiently and easily remove the current that sneaks into the output terminal VOUT, and to employ the low-voltage power supply for driving at a high speed.

Also, furthermore, in the band gap circuit of the embodiment 2, the low-pass filter can be configured of the p-type transistor P5 and the resistor R2 of the output terminal VOUT side. For this, the low-pass filter allows the power supply noise in the high-frequency region of the power supply voltage VDD to be surely removed, and the PSRR to be raised for improving it all the more. This allows the band gap circuit suitable for the high-speed operation to be configured, and the band gap circuit having a short stability time and a high PSRR to be realized.

In accordance with the present invention, the band gap circuit can be provided in which the excess current that transitionally sneaks into the circuit output terminal can be efficiently removed, and the PSRR is enhanced, and the stability time of the voltage at the circuit output terminal can be curtailed.

What is claimed is:

1. A band gap circuit for generating an output voltage to be outputted from a circuit output terminal, which is connected to a power supply voltage source and a reference potential point, said band gap circuit comprising:

a differential amplifier having an inverting input terminal, a noninverting input terminal, and an output terminal;

a first circuit for causing a potential difference to occur at said inverting input terminal and said non inverting input terminal in response to fluctuation of the voltage on said circuit output terminal, said first circuit including a first element comprising an ion implantation resistor having a capacitive component;

a switching element for causing excess current from said circuit output terminal to flow to said reference potential point in response to fluctuation of potential at said output terminal of said differential amplifier, said switching element being connected to said circuit output terminal and said reference potential point and being directly connected to said output terminal of said differential amplifier; and a second element having a resistive component, wherein:

said first and second elements are connected to remove power supply noise in the power supply voltage source.

2. The band gap circuit according to claim 1, wherein said switching element comprises a N-channel MOS transistor.

3. The band gap circuit according to claim 1, wherein said second element comprises a transistor.

4. A band gap circuit for generating an output voltage to be outputted from a circuit output terminal, which is connected to a power supply voltage source and a reference potential point, said band gap circuit comprising:

a differential amplifier having an inverting input terminal, a noninverting input terminal, and an output terminal;

a first circuit for causing a potential difference to occur at said inverting input terminal and said noninverting input terminal in response to fluctuation of the voltage on said circuit output terminal, said first circuit including a first element comprising an ion implantation resistor having a capacitive component;

a switching element for causing excess current from said circuit output terminal to flow to said reference potential point in response to fluctuation of potential at said output terminal of said differential amplifier, said switching element being connected to said circuit output terminal, said reference potential point, and said output terminal of said differential amplifier, and a second element having a resistive component, said second element being connected to said power supply voltage source and said circuit output terminal, wherein:

said second element is connected to said first element.

5. The band gap circuit according to claim 4, wherein said switching element comprises a N-channel MOS transistor.

6. The band gap circuit according to claim 4, wherein said second element comprises a transistor.

7. A band gap circuit, comprising:

a voltage supply circuit adapted to be connected to a power supply voltage source;

a reference potential point, a circuit output terminal connected to said voltage supply circuit;

a differential amplifier connected to said voltage supply circuit and having an inverting input terminal, a noninverting input terminal, and an output terminal;

a first circuit comprising an ion implantation resistor having a capacitive component, for causing a potential difference to occur at said inverting input terminal and said noninverting input terminal in response to fluctuation of the voltage on said circuit output terminal; and a switching element for causing excess current from said circuit output terminal to flow to said reference potential point in response to fluctuation of potential at said output terminal of said differential amplifier, said switching element being connected to said circuit output terminal, said reference potential point, and said output terminal of said differential amplifier, wherein:

said voltage supply circuit comprises a constant current source, a first transistor coupling said differential amplifier to the power supply voltage source and said constant current source, and a second transistor coupling said circuit output terminal to the power supply voltage source and said constant current source.

8. The band gap circuit according to claim 7, wherein said second transistor and said ion implantation resistor are connected to remove power supply noise in the power supply voltage source.

9. The band gap circuit according to claim 7, wherein said switching element comprises a N-channel MOS transistor.

10. A band gap circuit comprising;

a voltage supply circuit adapted to be connected to a power supply voltage source;

a reference potential point;

a circuit output terminal connected to said voltage supply circuit;

a differential amplifier connected to said voltage supply circuit and having an inverting input terminal, a noninverting input terminal, and an output terminal;

a first circuit comprising an ion implantation resistor having a capacitive component for causing a potential difference to occur at said inverting input terminal and said noninverting input terminal in response to fluctuation of the voltage on said circuit output terminal; and a switching element for causing excess current from said circuit output terminal to flow to said reference potential point in response to fluctuation of potential at said output terminal of said differential amplifier, said switching element being connected to said circuit output terminal, said reference potential point, and said output terminal of said differential amplifier, wherein:

said voltage supply circuit comprises a constant current source, a first pair of cascaded transistors coupling said differential amplifier to the power supply voltage source and said constant current source, and a second pair of cascaded transistors coupling said circuit output terminal to the power supply voltage source and said constant current source.

11. The band gap circuit according to claim 10, wherein said second pair of cascaded transistors and said ion implantation resistor are connected to remove power supply noise in the power supply voltage source.

12. The band gap circuit according to claim 10, wherein said switching element comprises a N-channel MOS transistor.

13. A band gap circuit, comprising:

a voltage supply circuit adapted to be connected to a power supply voltage source;

a reference potential point;

a circuit output terminal connected to said voltage supply circuit;

a differential amplifier connected to said voltage supply circuit and having an inverting input terminal, a noninverting input terminal, and an output terminal;

a switching element for causing excess current from said circuit output terminal to flow to said reference potential point in response to fluctuation of potential at said output terminal of said differential amplifier, said switching element being connected to said circuit output terminal, said reference potential point, and said output terminal of said differential amplifier; and an ion implantation resistor having a capacitive component, and connected to said circuit output terminal, wherein;

said voltage supply circuit comprises a constant current source, a first transistor coupling said differential amplifier to the power supply voltage source and said constant current source, and a second transistor having a resistive component and coupling said circuit output terminal to the power supply voltage source and said constant current source.

14. The band gap circuit according to claim 13, wherein said switching element comprises a N-channel MOS transistor.

15. A band gap circuit comprising:

a voltage supply circuit adapted to be connected to a power supply voltage source;

a reference potential point;

a circuit output terminal connected to said voltage supply circuit;

a differential amplifier connected to said voltage supply circuit and having an inverting input terminal, a noninverting input terminal, and an output terminal;

a switching element for causing excess current from said circuit output terminal to flow to said reference potential point in response to fluctuation of potential at said output terminal of said differential amplifier, said switching element being connected to said circuit output terminal, said reference potential point and said output terminal of said differential, amplifier; and an ion implantation resistor having a capacitive component and being connected to said circuit output terminal, wherein:

said voltage supply circuit comprises a constant current source, a first pair of cascaded transistors coupling said differential amplifier to the power supply voltage source and said constant current source, and a second pair of cascaded transistors coupling said circuit output terminal to the power supply voltage source and said constant current source.

16. The band gap circuit according to claim 15, wherein said switching element comprises a N-channel MOS transistor.

* * * * *

UNITED STATES PATENT AND TRADEMARK OFFICE

CERTIFICATE OF CORRECTION

PATENT NO. : 7,098,729 B2
APPLICATION NO. : 10/647468
DATED : August 29, 2006
INVENTOR(S) : Osamu Abe It is certified that error appears in the above-identified patent and that said Letters Patent is hereby corrected as shown below:

On the title page item (73), should read
(73) Assignee: NEC Electronics Corporation,
Kanagawa (JP)

Signed and Sealed this

Nineteenth Day of December, 2006

JON W. DUDAS
*Director of the United States Patent and Trademark Office*